US008091853B2

(12) United States Patent
Clores

(10) Patent No.: US 8,091,853 B2
(45) Date of Patent: Jan. 10, 2012

(54) POLE TYPE MEMBER SUPPORT DEVICE AND METHOD THEREFOR

(76) Inventor: Edgardo Clores, Las Vegas, NV (US)

( * ) Notice: Subject to any disclaimer, the term of this patent is extended or adjusted under 35 U.S.C. 154(b) by 10 days.

(21) Appl. No.: 12/762,857

(22) Filed: Apr. 19, 2010

(65) Prior Publication Data

US 2011/0253875 A1 Oct. 20, 2011

(51) Int. Cl.
*F16M 13/00* (2006.01)

(52) U.S. Cl. ..... 248/523; 47/45.5

(58) Field of Classification Search ..... 248/519, 248/523, 527; 47/40.5
See application file for complete search history.

(56) References Cited

U.S. PATENT DOCUMENTS

| | | | | |
|---|---|---|---|---|
| 1,298,380 | A | 3/1919 | Owen | 248/523 |
| 1,931,376 | A | 10/1933 | Cosner | 248/527 |
| 1,997,870 | A | 4/1935 | Patterson | 248/524 |
| 2,605,067 | A | 7/1952 | Lindsell | 47/40.5 |
| 2,905,414 | A | 9/1959 | Zierden | 47/40.5 |
| 2,938,304 | A * | 5/1960 | Thomas et al. | 47/57.5 |
| 3,038,689 | A | 6/1962 | Matson | 47/40.5 |
| 4,286,409 | A | 9/1981 | Taylor et al. | 47/40.5 |
| 4,436,272 | A | 3/1984 | Lile et al. | 248/527 |
| 4,901,971 | A | 2/1990 | Connelly | 248/523 |
| 5,014,461 | A | 5/1991 | von Braucke et al. | 47/40.5 |
| 5,074,514 | A | 12/1991 | Smith | 248/524 |
| 5,137,246 | A | 8/1992 | Idso | 248/523 |
| 5,452,877 | A | 9/1995 | Riffle et al. | 248/511 |
| 5,782,453 | A | 7/1998 | Tuzza et al. | 248/523 |
| 5,918,849 | A * | 7/1999 | Bliss | 248/523 |
| 5,938,168 | A | 8/1999 | Adams | 248/523 |
| 5,970,655 | A | 10/1999 | Freeman | 47/43 |
| 6,145,795 | A * | 11/2000 | McAdam et al. | 248/146 |
| 6,299,124 | B1 | 10/2001 | Reback et al. | 248/519 |
| 6,745,991 | B1 * | 6/2004 | Rush | 248/523 |
| 7,168,437 | B2 | 1/2007 | Bigford | 135/16 |
| 2004/0045216 | A1 * | 3/2004 | Fiveash | 47/40.5 |
| 2008/0035826 | A1 | 2/2008 | Clores et al. | 248/523 |
| 2009/0100789 | A1 * | 4/2009 | Hornbeak et al. | 52/745.19 |
| 2010/0313471 | A1 * | 12/2010 | Middaugh | 47/40.5 |

FOREIGN PATENT DOCUMENTS

DE 3609357 A1 * 10/1987

* cited by examiner

*Primary Examiner* — Ramon Ramirez
(74) *Attorney, Agent, or Firm* — Jeffrey D. Moy; Weiss & Moy, P.C.

(57) ABSTRACT

A pole type member support device has a conical shaped receptacle. The conical shaped receptacle has an opening formed in a top section thereof. The receptacle is tapered so that the top section of the receptacle is larger than a bottom section. A channel is formed around an outer perimeter of the top section of the receptacle. A support arm is slideably coupled within the channel and is used for supporting the pole type member in an upright position. A locking device is adapted to be inserted into and withdrawn from the opening formed in the top section of the receptacle for securing the pole type member in an upright position. A base member is provided for holding the receptacle.

19 Claims, 6 Drawing Sheets

POLE TYPE MEMBER SUPPORT DEVICE AND METHOD THEREFOR

RELATED APPLICATIONS

This application is related to application Ser. No. 11/500,729 filed Aug. 8, 2006, entitled POLE-TYPE MEMBER SUPPORT DEVICE AND METHOD THEREFOR, and TO application Ser. No. 11/731,886 filed Apr. 2, 2007, entitled TREE SUPPORTING DEVICE AND METHOD both by one of the same named inventors and is incorporated by reference.

FIELD OF THE INVENTION

This invention relates to tree supporting devices and methods and, more specifically, to a tree support device and method for securely supporting trees and other elongated objects in an upright position for an extended period of time.

BACKGROUND OF THE INVENTION

During the holiday season, many people bring Christmas trees into their homes for both decorative and religious purposes. The Christmas trees often vary in height and size, creating varying degrees of difficulty in supporting the trees in a stable position. Other people purchase or rent trees, tiki torches or other pole-type items for special events and occasions. In these cases as well, it is difficult to support these items in a stable manner. Often, the result is that the trees, poles or other items are either leaned against a wall or propped up in some other unstable way. This lack of a proper support device can lead to a number of unwanted consequences. A tree falling from an unstable position can cause not only property damage but can also physical harm to a person. Likewise, a falling tiki torch or a pole-type item with a candle or other lit object on top could ignite a fire.

Previous attempts have been made to provide a support device for Christmas trees. For example, U.S. Pat. No. 5,970,655 issued to Freeman discloses a Christmas tree resting inside a collar member having a radial extension and a rod between the tree and the radial extension. The Freeman patent requires the attachment of a rod to a portion of the tree, a time-consuming and difficult process. Additionally, the Freeman patent does not provide a collar capable of being adjusted to the varying thickness of different trees or other pole-type members.

Another example is U.S. Pat. No. 5,137,246 issued to Idso. Idso discloses a stand for Christmas trees comprised of a base plate with a pair of spaced-apart upright brackets mounted thereon. The tree holder receptacle is pivotally mounted between the upright brackets so that is can move about a horizontal axis in order to orient the tree trunk to a generally vertical position, A pair of locking levers is associated with the upright brackets so that they can be releasably clamped to orient the tree holder receptacle in any desired position. A set screw is provided to accept the tree into the tree holder receptacle. A problem with Idso is the lack of an adjustable support arm to provide proper support and stabilize the tree trunk in the tree stand.

Therefore, a need existed to provide a system and method to overcome the above problem.

SUMMARY OF THE INVENTION

In accordance with one embodiment, a pole type member support device has a conical shaped receptacle. The conical shaped receptacle has an opening formed in a top section thereof. The receptacle is tapered so that the top section of the receptacle is larger than a bottom section. A channel is formed around an outer perimeter of the top section of the receptacle. A support arm is slideably coupled within the channel and is used for supporting the pole type member in an upright position. A locking device is adapted to be inserted into and withdrawn from the opening formed in the top section of the receptacle for securing the pole type member in an upright position. A base member is provided for holding the receptacle.

The present invention is best understood by reference to the following detailed description when read in conjunction with the accompanying drawings.

BRIEF DESCRIPTION OF THE DRAWINGS

Common reference numerals are used throughout the drawings and detailed description to indicate like elements.

DETAILED DESCRIPTION

Figure 1:
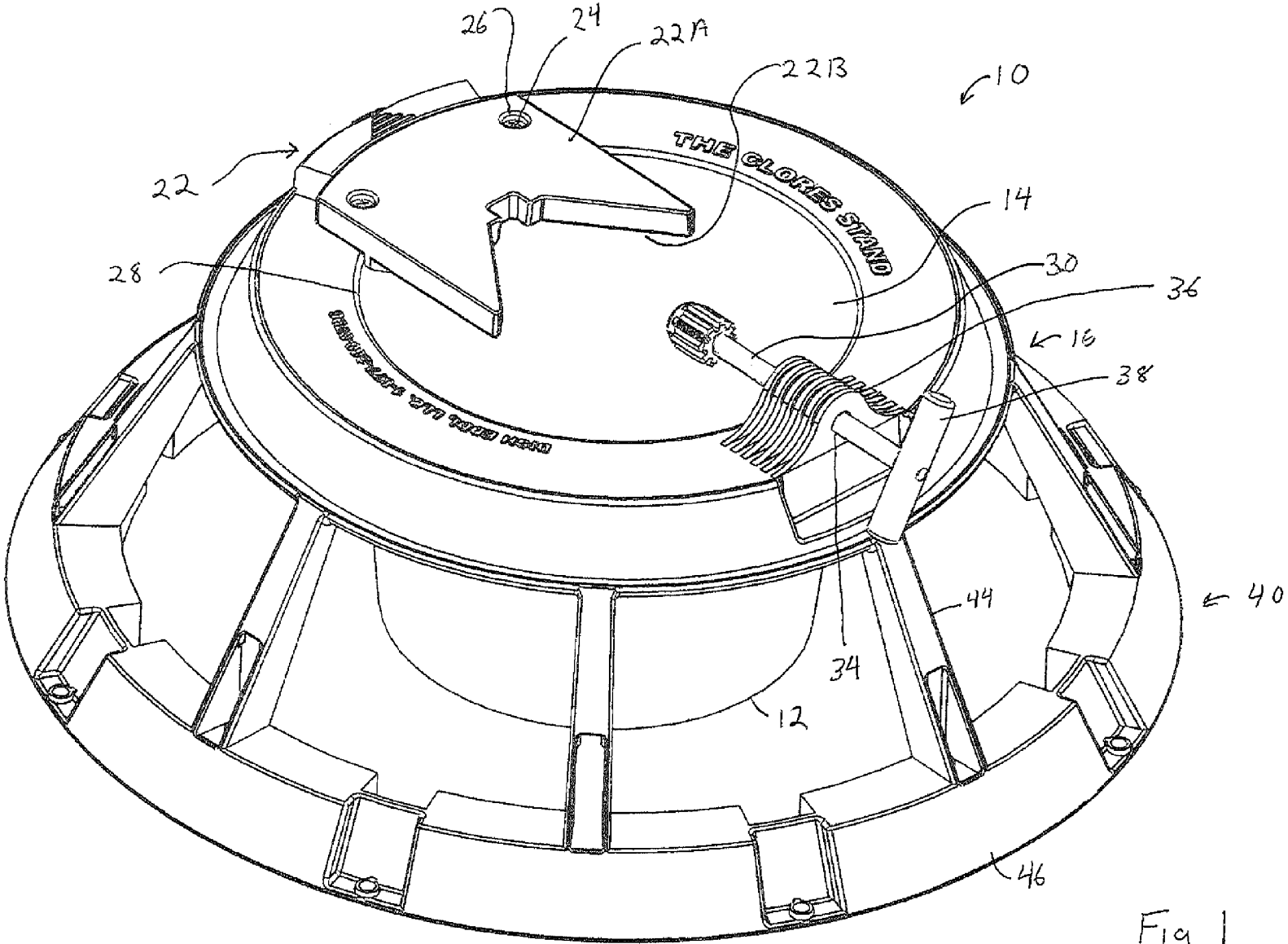
FIG. 1 is a perspective view of the pole-type member support device of the present invention.
Figure 2:
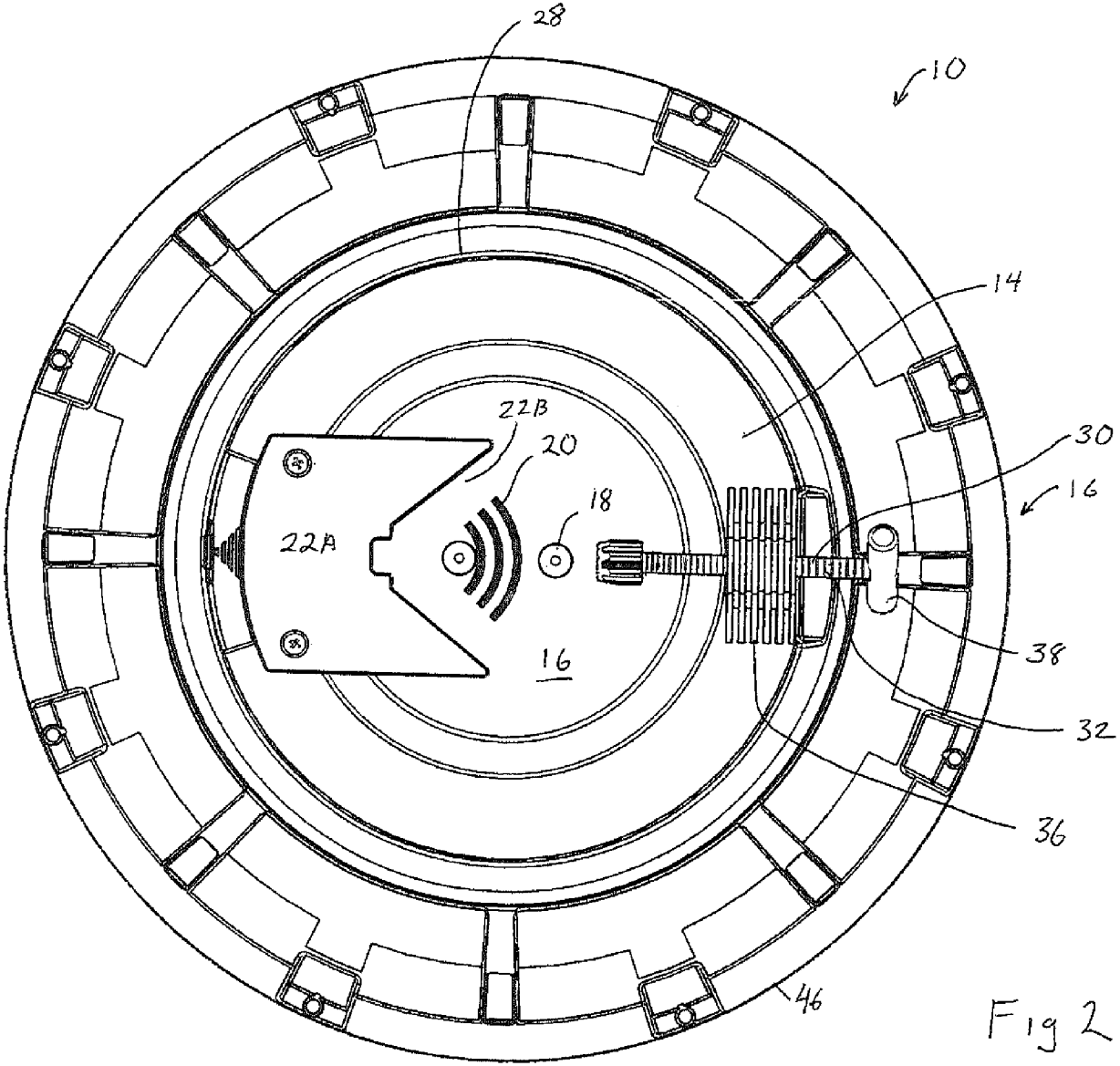
FIG. 2 is a top view of the pole-type member support device of the present invention with the movable support device.
Figure 3:
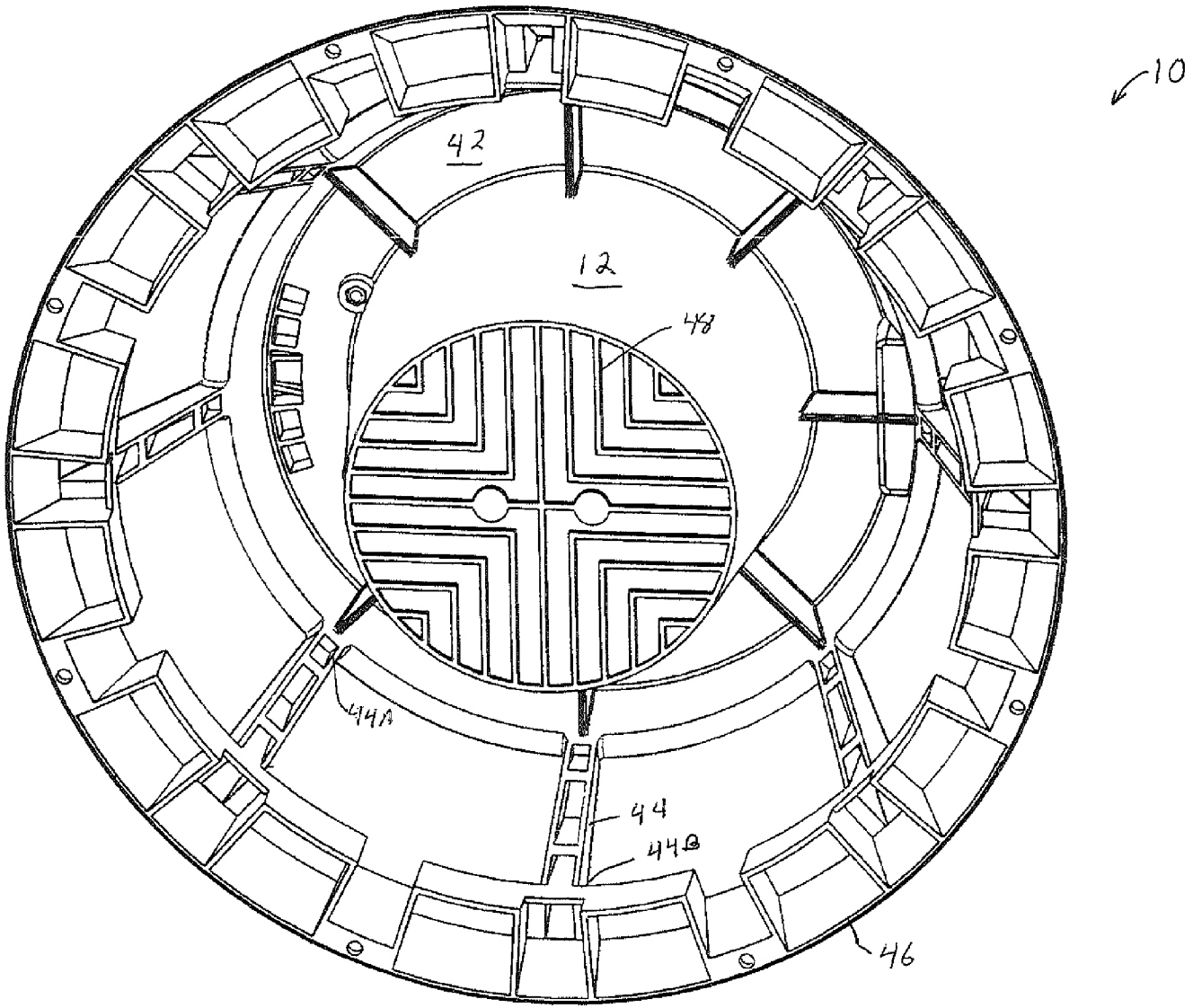
FIG. 3 is a bottom view of the pole-type member support device of the present invention with the movable support device.

Referring to FIGS. 1-3, an improved pole-type member support device 10 (hereinafter support device 10) is shown. The support device 10 configured for stable placement on a surface to hold a pole-type member, including a Christmas tree or the like, upright for an extended period of time. The support device 10 may be constructed to contain water to keep the tree hydrated during positioning in the support device 10.

The support device 10 comprises a hollow receptacle body 12. The receptacle body 12 is generally conical in shape. The receptacle body 12 is slightly tapered from a top section of the receptacle body 12 to a bottom section of the receptacle body 12 such that the top section is slightly larger than the bottom section. The receptacle body 12 has a pole receiving opening 14 formed in the top section therein. The opening 14 is generally circular in shape. The bottom section of the receptacle body 12 may be enclosed by a bottom surface member 16. The bottom surface member 16 may allow the support device 10 to be filled with and store a liquid such as water.

Located on the bottom surface member 16 in an interior of the support device 12 may be a plurality of spike members 18. The spike members 18 may be used to hold a pole-type member, including a Christmas tree or the like, in position and to prevent the pole-type member from slipping and or moving along the bottom surface member 16. The bottom surface member 16 may further have a texturized surface. Thus, a plurality of ridges 20 or the like may be formed on the bottom surface member 16. The ridges 20 may further be used to aid in preventing the pole-type member from slipping and or moving along the bottom surface member 16.

A support arm 22 may be coupled to the top section of the receptacle body 12. The support arm 22 may be used to support and hold the pole-type member, in position and to keep the pole-type structure in an upright position. The support arm 22 may be adjustable. Thus, the support arm 22 may be positioned anywhere along the top section of the receptacle body 12 in order to support and hold the pole-type member in position and to keep the pole-type structure in an upright position. In accordance with one embodiment, the support arm is formed of a body section 22A. The body section 22A is adjustable coupled to the top section of the receptacle body 12. A V-shaped cut-out 22B is formed in a distal end of the body section 22A. The V-shaped cut-out 22B may be sued to support and hold the pole-type member in position and to keep the pole-type structure in an upright position. In general, the pole-type structure may be positioned within the V-shaped cut-out 22B.

One or more clamping device 24 may be used to secure the support arm 22 in position. Thus, after locating the proper positioned for the support arm 22 to support and hold the pole-type member in position and to keep the pole-type structure in an upright position, the clamping devices 22 may be used to secure the support arm 22 to the top section of the receptacle body 12. In accordance with one embodiment, a pair of openings 26 is formed through the body section 22A of the support arm 22. A clamping device 24 is positioned through each of the openings 26 to secure the secure the support arm 22 to the top section of the receptacle body 12.

In accordance with one embodiment, a channel 28 is formed around an outer perimeter of the top section of the receptacle body 12. A proximal end of the body section 22A of the support arm 22 is positioned in the channel 28 and is slideably movable within the channel 28. Thus, the support arm 22 may be rotated anywhere around the channel 28 to a position along the top section of the receptacle body 12 in order to support and hold the pole-type member in position and to keep the pole-type structure in an upright position.

A locking device 16 may be coupled to the top section of the receptacle body 12. The locking device 16 may be used to secure the pole-type member in position and to keep the pole-type structure in an upright position. In accordance with the present embodiment, the locking device 16 has a rod member 30. A handle 38 is formed on one end of the rod member 30. A plurality of threads 32 may be formed on the rod member 30. The threads 32 engage a threaded opening 34 in a base member 36. The base member 36 is attached to the top surface of the receptacle body 12. The threads 32 of the rod member 30 engage the threaded opening 34 in a base member 36 to allow the rod member 30 to be rotated about its own vertical axis to a desired position. Depending on a direction of such rotation, the rod member 30 may be inserted into or withdrawn from an interior of the receptacle body 12. In general, the rod member 30 may be rotated so that the rod member 30 may be screwed into the tree trunk by turning a handle 38 attached to the end of the rod member 30 to fixedly secure the tree in the support device 10.

The receptacle body 12 has a base member 40 coupled thereto. The base member 40 may be used to hold the receptacle body 12 and to provide additional stability to the support device 10 to prevent the support device 10 from tipping over. In accordance with one embodiment, the base member 40 may have a top ring member 42. The top ring member 42 may have an inner diameter which is smaller than the outer perimeter of the top section of the receptacle body 12. This will allow the receptacle body 12 to sit within the top ring member 42 of the receptacle body 12.

A plurality of leg members 44 have a first end 44A attached to and extending down and away from the top ring member 42. By extending down and away from the top ring member 42, the leg members 44 may allow the base member 40 to cover a wider area to provide more stability for the support device 10. In accordance with one embodiment, the leg members 44 extend away from the top ring member 42 at an approximately 45° angle. However, this is just one embodiment and should not be seen in a limiting manner.

A second end 44B of the leg members 44 may be attached to a bottom ring member 46. Since the leg members 44 extend down and away from the top ring member 42, the bottom ring member 46 will have a larger diameter than the top ring member 42 thereby providing a more stable platform for the support device 10. As shown in the Figures, the bottom ring member 46 may have an additional thickness/width to further provide a more stable platform for the support device 10. In accordance with one embodiment, the bottom ring member may have an outer diameter which is approximately one inch greater than an inner diameter.

The base member 40 is designed to provide optimal support of the receptacle body 12. Since the base member 40 is not of solid one piece unit, the base member 40 will be lighter in weight than current designs while providing the same support.

The bottom surface receptacle body 12 may have a slip resistant material 48 applied thereon. The slip resistant material 48 may provide additional traction for the support device 10. This will aid in preventing the support device 10 from moving.

Figure 4:
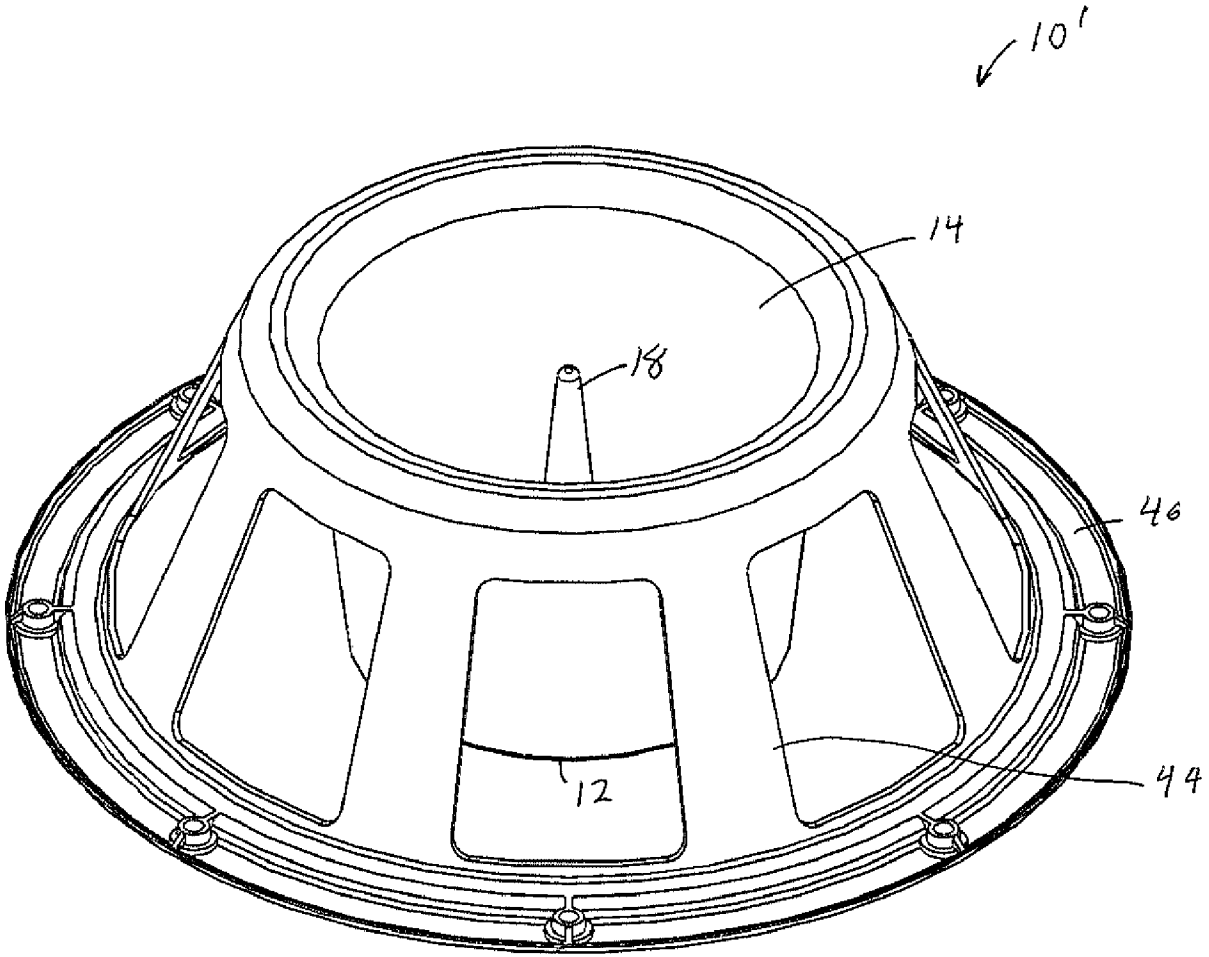
FIG. 4 is a perspective view of another embodiment of the pole-type member support device of the present invention.
Figure 5:
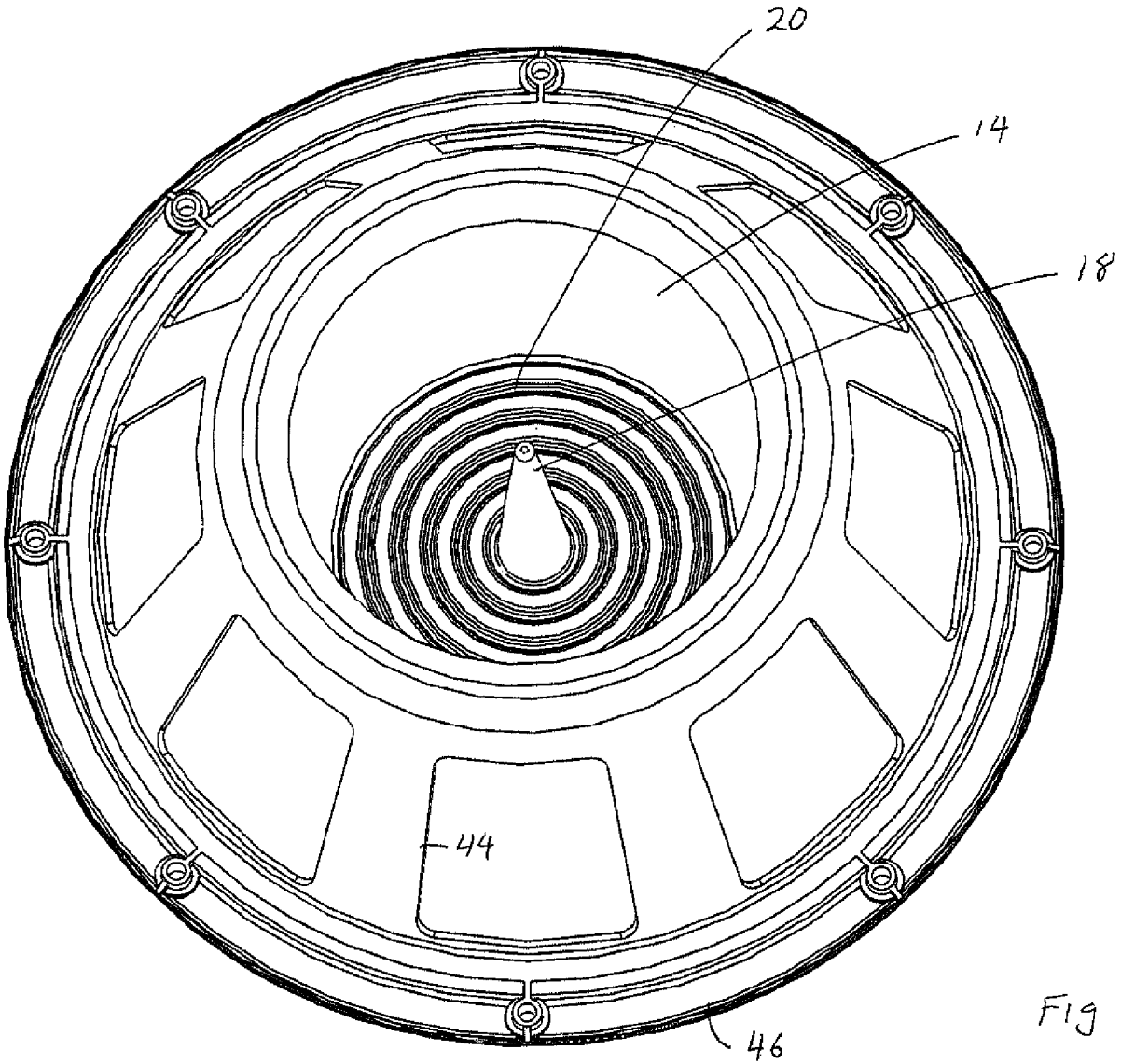
FIG. 5 is a top view of the pole-type member support device of the present invention with the movable support device.
Figure 6:
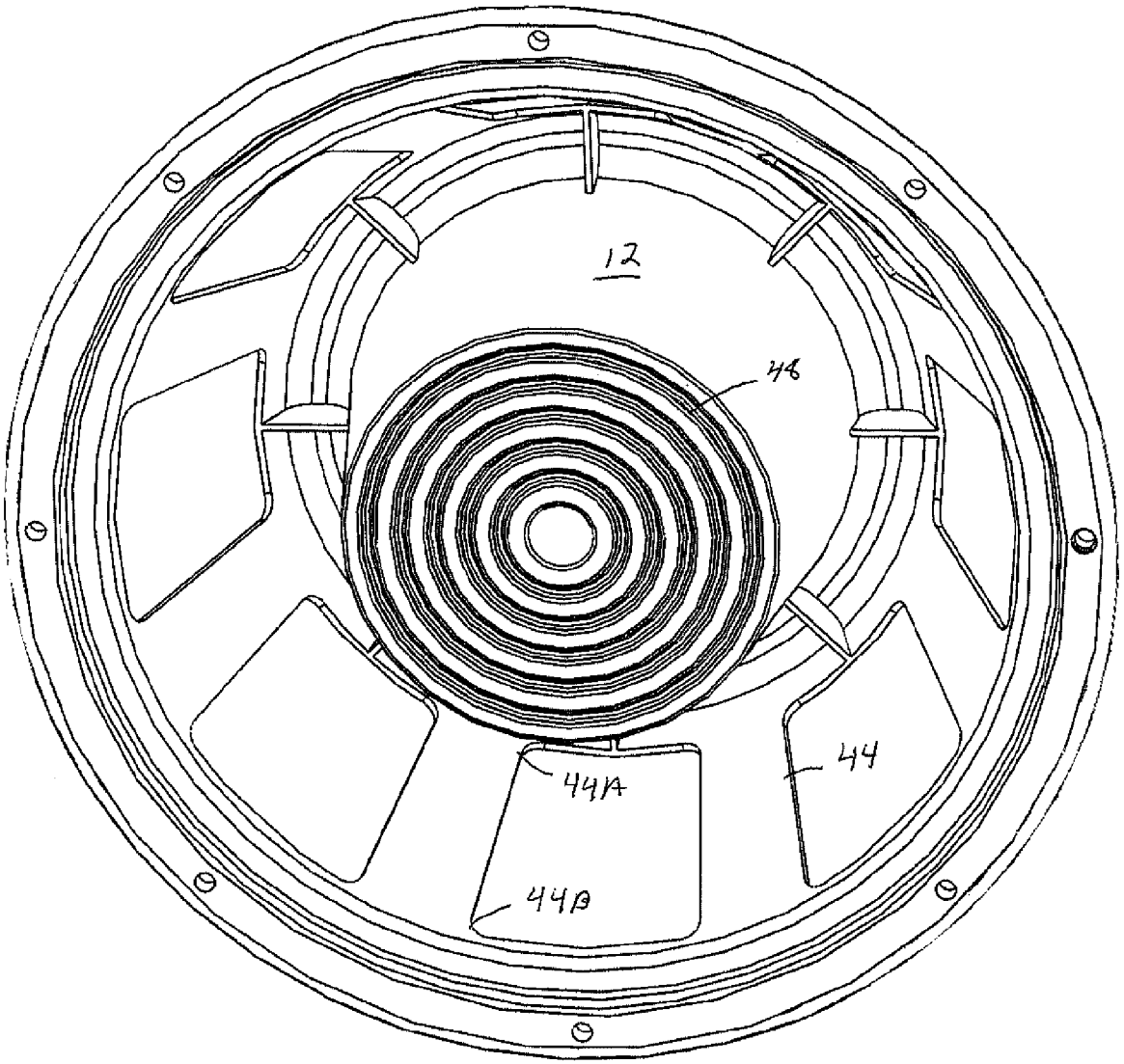
FIG. 6 is a bottom view of the pole-type member support device of the present invention with the movable support device.

Referring to FIGS. 4-6, another embodiment of the improved pole-type member support device 10' (hereinafter support device 10') is shown. The support device 10' configured for stable placement on a surface to hold a pole-type member, including a Christmas tree or the like, upright for an extended period of time. The support device 10 may be constructed to contain water to keep the tree hydrated during positioning in the support device 10.

The support device 10 comprises a hollow receptacle body 12. The receptacle body 12. The receptacle body 12 is generally conical in shape. The receptacle body 12 is slightly from a top section of the receptacle body 12 to a bottom section of the receptacle body 12 such that the top section is slightly larger than the bottom section. The receptacle body 12 has a pole receiving opening 14 formed in the top section therein. The opening 14 is generally circular in shape. The bottom section of the receptacle body 12 may be enclosed by a bottom surface member 16. The bottom surface member 16 may allow the support device 10 to be filled with and store a liquid such as water.

Located on the bottom surface member 16 in an interior of the support device 12 may be a single spike members 18. The spike member 18 is centrally located on the bottom surface member 16. The spike members 18 may be used to hold a pole-type member, including a Christmas tree or the like, in position and to prevent the pole-type member from slipping and or moving along the bottom surface member 16. The bottom surface member 16 may further have a texturized surface. Thus, a plurality of ridges 20 or the like may be formed on the bottom surface member 16. The ridges 20 may further be used to aid in preventing the pole-type member from slipping and or moving along the bottom surface member 16.

The receptacle body 12 has a base member 40 coupled thereto. The base member 40 may be used to hold the receptacle body 12 and to provide additional stability to the support device 10 to prevent the support device 10 from tipping over.

In accordance with one embodiment, the base member 40 may have a top ring member 42. The top ring member 42 may have an inner diameter which is smaller than the outer perimeter of the top section of the receptacle body 12. This will allow the receptacle body 12 to sit within the top ring member 42 of the receptacle body 12.

A plurality of leg members 44 have a first end 44A attached to and extending down and away from the top ring member 42. By extending down and away from the top ring member 42, the leg members 44 may allow the base member 40 to cover a wider area to provide more stability for the support device 10. In accordance with one embodiment, the leg members 44 extend away from the top ring member 42 at an approximately 45° angle. However, this is just one embodiment and should not be seen in a limiting manner.

A second end 44B of the leg members 44 may be attached to a bottom ring member 46. Since the leg members 44 extend down and away from the top ring member 42, the bottom ring member 46 will have a larger diameter than the top ring member 42 thereby providing a more stable platform for the support device 10. As shown in the Figures, the bottom ring member 46 may have an additional thickness/width to further provide a more stable platform for the support device 10. In accordance with one embodiment, the bottom ring member may have an outer diameter which is approximately one inch greater than an inner diameter.

The base member 40 is designed to provide optimal support of the receptacle body 12. Since the base member 40 is not of solid one piece unit, the base member 40 will be lighter in weight than current designs while providing the same support.

The bottom surface receptacle body 12 may have a slip resistant material 48 applied thereon. The slip resistant material 48 may provide additional traction for the support device 10. This will aid in preventing the support device 10 from moving.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A pole type member support device comprising:
- a conical shaped receptacle having an opening formed in a top section thereof, the receptacle tapered so that the top section of the receptacle is larger than a bottom section;
- a channel formed around an outer perimeter of the top section of the receptacle;
- a support arm slideably coupled within the channel for supporting the pole type member in an upright position;
- a locking device adapted to be inserted into and withdrawn from the opening formed in the top section of the receptacle for securing the pole type member in an upright position; and
- a base member for holding the receptacle.

2. A pole type member support device in accordance with claim 1, further comprising a securing device removably coupled to the support arm to lock the support arm in a desired position.

3. A pole type member support device in accordance with claim 1, further comprising spike members formed on a bottom interior section of the receptacle.

4. A pole type member support device in accordance with claim 1, further comprising ridge members formed on a bottom interior section of the receptacle.

5. A pole type member support device in accordance with claim 1, further comprising a slap resistant material applied to a bottom exterior surface of the receptacle.

6. A pole type member support device in accordance with claim 1, wherein the base member comprises:
- a top ring member, the receptacle positioned within an opening in the top ring member;
- a plurality of leg members having a first end attached to the top ring member and extending down and away from the top ring member; and
- a bottom ring member, a second end of each of the plurality of leg members attached to the bottom ring member.

7. A pole type member support device in accordance with claim 6, wherein a diameter of the bottom ring member is greater than a diameter of the top ring member.

8. A pole type member support device in accordance with claim 1, wherein the locking device comprises:
- a base member having a threaded channel; and
- a threaded rod member adapted to be inserted into and withdrawn from the threaded channel.

9. A pole type member support device in accordance with claim 8, wherein the locking device further comprises a handle attached to the threaded rod member.

10. A pole type member support device comprising:
- a conical shaped receptacle having an opening formed in a top section thereof, the receptacle tapered so that the top section of the receptacle is larger than a bottom section;
- spike members formed on a bottom interior section of the receptacle;
- a channel formed around an outer perimeter of the top section of the receptacle;
- a support arm slideably coupled within the channel for supporting the pole type member in an upright position;
- a securing device removably coupled to the support arm to lock the support arm in a desired position;
- a locking device adapted to be inserted into and withdrawn from the opening formed in the top section of the receptacle for securing the pole type member in an upright position;
- a base member for holding the receptacle; and
- a slap resistant material applied to a bottom exterior surface of the receptacle.

11. A pole type member support device in accordance with claim 10, further comprising ridge members formed on a bottom interior section of the receptacle.

12. A pole type member support device in accordance with claim 10, wherein the base member comprises:
- a top ring member, the receptacle positioned within an opening in the top ring member;
- a plurality of leg members having a first end attached to the top ring member and extending down and away from the top ring member; and
- a bottom ring member, a second end of each of the plurality of leg members attached to the bottom ring member.

13. A pole type member support device in accordance with claim 12, wherein a diameter of the bottom ring member is greater than a diameter of the top ring member.

14. A pole type member support device in accordance with claim 10, wherein the locking device comprises:
- a base member having a threaded channel; and
- a threaded rod member adapted to be inserted into and withdrawn from the threaded channel.

15. A pole type member support device in accordance with claim 14, wherein the locking device further comprises a handle attached to the threaded rod member.

16. A pole type member support device comprising:

a conical shaped receptacle having an opening formed in a top section thereof, the receptacle tapered so that the top section of the receptacle is larger than a bottom section;

spike members formed on a bottom interior section of the receptacle;

a channel formed around an outer perimeter of the top section of the receptacle;

a support arm slideably coupled within the channel for supporting the pole type member in an upright position;

a securing device removably coupled to the support arm to lock the support arm in a desired position;

a locking device adapted to be inserted into and withdrawn from the opening formed in the top section of the receptacle for securing the pole type member in an upright position;

a slap resistant material applied to a bottom exterior surface of the receptacle; and a base member for holding the receptacle, wherein the base member comprises:

a top ring member, the receptacle positioned within an opening in the top ring member;

a plurality of leg members having a first end attached to the top ring member and extending down and away from the top ring member; and a bottom ring member, a second end of each of the plurality of leg members attached to the bottom ring member;

wherein a diameter of the bottom ring member is greater than a diameter of the top ring member.

17. A pole type member support device in accordance with claim 16, further comprising ridge members formed on a bottom interior section of the receptacle.

18. A pole type member support device in accordance with claim 16, wherein the locking device comprises:

a base member having a threaded channel; and a threaded rod member adapted to be inserted into and withdrawn from the threaded channel.

19. A pole type member support device in accordance with claim 18, wherein the locking device further comprises a handle attached to the threaded rod member.

* * * * *